US010984720B2

(12) United States Patent
Hu

(10) Patent No.: US 10,984,720 B2
(45) Date of Patent: Apr. 20, 2021

(54) DRIVING METHOD AND DRIVING APPARATUS OF DISPLAY PANEL

(71) Applicants: HKC Corporation Limited, Shenzhen (CN); Chongqing HKC Optoelectronics Technology Co., ltd., Chongqing (CN)

(72) Inventor: Shuixiu Hu, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/631,112

(22) PCT Filed: Sep. 20, 2017

(86) PCT No.: PCT/CN2017/102462
§ 371 (c)(1),
(2) Date: Jan. 14, 2020

(87) PCT Pub. No.: WO2019/015074
PCT Pub. Date: Jan. 24, 2019

(65) Prior Publication Data

US 2020/0273407 A1 Aug. 27, 2020

(30) Foreign Application Priority Data

Jul. 21, 2017 (CN) ..... 201710602391.8

(51) Int. Cl.
*G09G 3/3258* (2016.01)
*G09G 3/3275* (2016.01)
*G09G 3/36* (2006.01)

(52) U.S. Cl.
CPC ..... *G09G 3/3258* (2013.01); *G09G 3/3275* (2013.01); *G09G 3/3688* (2013.01); *G09G 2310/08* (2013.01); *G09G 2320/0242* (2013.01)

(58) Field of Classification Search
CPC .. G09G 3/3258; G09G 3/3275; G09G 3/3688; G09G 3/3266; G09G 3/3677; G09G 3/3291; G09G 2310/08; G09G 2320/0242; G09G 2300/0426
See application file for complete search history.

(56) References Cited

U.S. PATENT DOCUMENTS

2006/0158395 A1* 7/2006 Kubota ..... G09G 3/3258 345/76
2006/0164360 A1* 7/2006 Wakabayashi ..... G09G 3/3266 345/94

(Continued)

FOREIGN PATENT DOCUMENTS

CN 106782275 5/2017

*Primary Examiner* — Tom V Sheng
(74) *Attorney, Agent, or Firm* — WPAT, PC

(57) ABSTRACT

A driving method and a driving apparatus of a display panel are provided. The driving method includes: detecting voltage change delay times of data lines in a fan-out area; controlling data output signals of the data lines according to the voltage change delay times; and adjusting a scan line driving voltage signal according to the data output signal and thereby making effective charging times of pixels driven by different data lines be consistent.

10 Claims, 6 Drawing Sheets

(56) References Cited

U.S. PATENT DOCUMENTS

| | | | | |
|---|---|---|---|---|
| 2009/0112553 | A1* | 4/2009 | Li | G06F 30/30 703/14 |
| 2010/0156885 | A1* | 6/2010 | Cho | G09G 3/006 345/214 |
| 2013/0314392 | A1* | 11/2013 | Kim | G09G 3/3266 345/212 |
| 2014/0176406 | A1* | 6/2014 | Guo | G09G 3/3688 345/87 |
| 2014/0375703 | A1* | 12/2014 | Ban | G09G 3/3688 345/691 |
| 2016/0118006 | A1* | 4/2016 | Park | G09G 3/3648 345/690 |
| 2017/0047016 | A1* | 2/2017 | Son | G09G 3/3266 |
| 2017/0323611 | A1* | 11/2017 | Jo | G09G 3/3696 |
| 2018/0158395 | A1* | 6/2018 | Chang | G09G 3/20 |
| 2018/0254004 | A1* | 9/2018 | Hsiao | G09G 3/20 |
| 2019/0371240 | A1* | 12/2019 | Mitani | G09G 3/3266 |

* cited by examiner

DRIVING METHOD AND DRIVING APPARATUS OF DISPLAY PANEL

FIELD OF THE DISCLOSURE

The disclosure relates to the field of display technology, and more particularly to a driving method of a display panel and a driving apparatus of a display panel.

BACKGROUND

For a thin film transistor liquid crystal display (TFT-LCD) technology, in the design of display panel array, output wires of a driver IC are required to brought together in a bonding area for layout processing, and the processing manner is a fan-out layout. Therefore, distances from the outputs of the driver IC to respective data lines in a display area are not equal, which results in resistances of data lines in the fan-out area being not consistent and thereby degrees of voltage change delays (also referred to as RC delays) of the data lines are different. As a result, effective charging times of pixels driven by data lines corresponding to a same scan line are not consistent, resulting in the issue of color shift.

A traditional solution of improving the color shift issue includes making wires of data lines in the fan-out area be made of a copper material, but such solution would result in relatively high cost in the TFT-LCD process. Another solution is decreasing output channels of each driver IC, but in such solution, because required data lines of the whole panel are fixed in quantity when a resolution of the panel is determined, the decrease of the output channels of each driver IC in quantity would cause the increase of the number of the driver ICs, and therefore also resulting in the increase of cost.

SUMMARY

Therefore, it is necessary to address the color shift problem resulting from inconsistency of effective charging times of pixels on different data lines but a same scan line, and provide a driving method and a driving apparatus of a display panel.

In particular, a driving method of a display panel includes: detecting voltage change delay times of data lines in a fan-out area, wherein the data lines include a first data line and a second data line; controlling data output signals of the data lines according to the voltage change delay times; and adjusting a scan line driving voltage signal according to the data output signals and thereby making effective charging times of pixels driven by different data lines be consistent.

In an embodiment, before the step of detecting voltage change delay times of data lines in a fan-out area, the driving method further includes: selecting the second data line and setting a failing edge time of the data output signal of the second data line.

In an embodiment, the step of detecting voltage change delay times of data lines in a fan-out area includes: measuring lengths of wires of the first data line and the second data line in the fan-out area; calculating resistances of the wires according to the lengths of the wires; and calculating voltage change delay times of the wires according to the resistances of the wires.

In an embodiment, the step of controlling data output signals of the data lines according to the voltage change delay times includes: comparing the voltage change delay times of the first data line and the second data line in the fan-out area; controlling a failing edge time of the data output signal of the first data line to be advanced if the voltage change delay time of the first data line in the fan-out area is greater than the voltage change delay time of the second data line in the fan-out area; keeping failing edge times of the data output signals of the first data line and the second data line to be the same if the voltage change delay time of the first data line in the fan-out area is equal to the voltage change delay time of the second data line in the fan-out area; controlling a failing edge time of the data output signal of the first data line to be postponed if the voltage change delay time of the first data line in the fan-out area is smaller than the voltage change delay time of the second data line in the fan-out area.

In an embodiment, the step of adjusting a scan line driving voltage signal according to the data output signals and thereby making effective charging times of pixels driven by different data lines be consistent includes: comparing a failing edge time of the data output signal of the first data line with a failing edge time of the data output signal of the second data line; inputting the scan line driving voltage signal according to the failing edge time of the data output signal of the first data line if the failing edge time of the data output signal of the first data line is ahead of the failing edge time of the data output signal of the second data line; inputting the scan line driving voltage signal according to the failing edge time of the data output signal of any one of the first data line and the second data line if the failing edge time of the data output signal of the first data line is same as the failing edge time of the data output signal of the second data line; inputting the scan line driving voltage signal according to the failing edge time of the data output signal of the second data line if the failing edge time of the data output signal of the first data line is later than the failing edge time of the data output signal of the second data line.

Moreover, a driving apparatus of a display panel, includes: a setting module, configured to select a second data line and set a data output signal of the second data line; a detecting module, configured to detect voltage change delay times of a first data line and the second data line in a fan-out area; a time control module, configured to control data output signals of the first data line and the second data line according to the voltage change delay times; and an adjusting module, configured to adjust a scan line driving voltage signal according to the data output signals and thereby make effective charging times of pixels driven by the first data line and the second data line be consistent.

In an embodiment, the detecting module includes a measuring unit and a calculating unit. The measuring unit is configured to measure lengths of wires of the first data line and the second data line in the fan-out area. The calculating unit is configured to calculate resistances of the wires according to the lengths of the wires and calculate voltage change delay times according to the resistances of the wires.

In an embodiment, the time control module includes a comparing unit and a time shift unit. The comparing unit is configured to compare the voltage change delay times of the first data line and the second data line in the fan-out area. The time shift unit is configured to control a failing edge time of the data output signal of the first data line to be advanced or postponed. The failing edge time of the data output signal of the first data line is controlled to be advanced if the voltage change delay time of the first data line in the fan-out area is greater than the voltage change delay time of the second data line in the fan-out area. Failing edge times of the data output signals of the first data line and the second data line are kept to be the same if the voltage change delay time of the first data line in the fan-out area is equal to the voltage change delay time of the second data line the fan-out area. The failing edge time of the data output signal of the first data line is controlled to be postponed if the voltage change delay time of the first data line in the fan-out area is smaller than the voltage change delay time of the second data line in the fan-out area.

In an embodiment, the adjusting module includes a comparison unit and an input unit. The comparison unit is configured to compare a failing edge time of the data output signal of the first data line with a failing edge time of the data output signal of the second data line. The input unit is configured to input the scan line driving voltage signal. The scan line driving voltage signal is inputted according to the failing edge time of the data output signal of the first data line if the failing edge time of the data output signal of the first data line is ahead of the failing edge time of the data output signal of the second data line. The scan line driving voltage signal is inputted according to the failing edge time of the data output signal of any one of the first data line and the second data line if the failing edge time of the data output signal of the first data line is same as the failing edge time of the data output signal of the second data line. The scan line driving voltage signal is inputted according to the failing edge time of the data output signal of the second data line if the failing edge time of the data output signal of the first data line is later than the failing edge time of the data output signal of the second data line.

In addition, a driving method of a display panel, includes: detecting a length of a wire of a data line in a fan-out area; judging the length of the wire whether is greater than a preset value, if YES, controlling a failing edge time of a data output signal of the data line to be advanced, and if NO, controlling a failing edge time of a data output signal of the data line to be postponed; and adjusting a scan line driving voltage signal according to the failing edge time of the data output signal and thereby making effective charging times of pixels driven by different data lines be consistent.

The driving method and the driving apparatus of a display panel change failing edge times of data output signals of different data lines, so that the color shift problem caused by different voltage change delays is improved and the optical grade of product is enhanced. Moreover, the method is unnecessary to change process requirement and product cost.

BRIEF DESCRIPTION OF THE DRAWINGS

One or more embodiments will be illustrated by exemplary descriptions with reference to figures in the accompanying drawings, and these exemplary descriptions are not to be construed as limiting the embodiments. Components or elements with same reference numerals in the drawings represent similar components or elements. Unless otherwise stated, the figures in the drawings are not given a scale limitation.

DETAILED DESCRIPTION OF EMBODIMENTS

Figure 1:
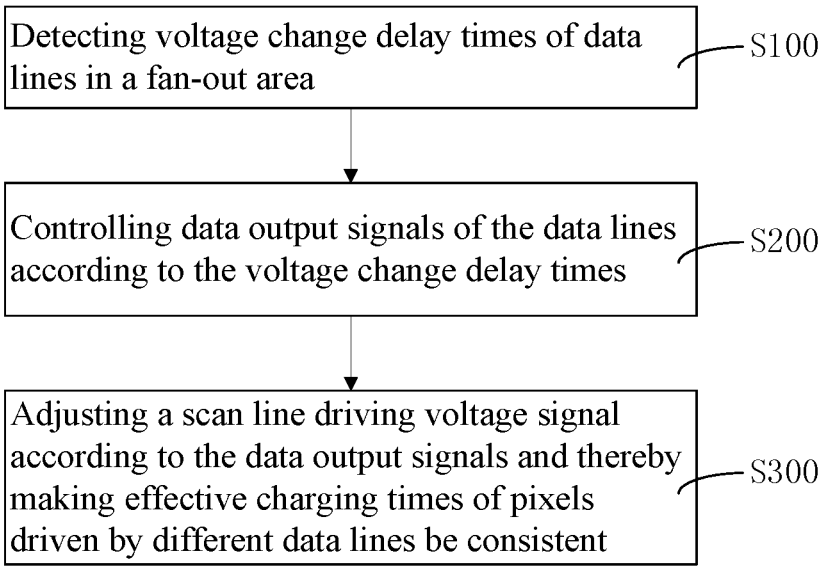
FIG. 1 is a flowchart of a driving method of a display panel according to an embodiment.

In order to facilitate the understanding of the disclosure, the disclosure will be more fully described below with reference to the accompanying drawings. Preferred embodiments of the disclosure are given in the drawings. However, the disclosure may be implemented in many different forms and is not limited to the embodiments described herein. Rather, these embodiments are provided so that the understanding of the contents of the disclosure will be more thorough and complete.

FIG. 1 is a flowchart of a driving method of a display panel according to an embodiment. The driving method includes following steps.

Step S100: detecting voltage change delay times of data lines in a fan-out area. Because a TFT-LCD in the design of pixel array needs to bright output wires of a driver IC together in a bonding area for layout processing and the processing manner is a fan-out layout, distances of from outputs of the driver IC to data lines in a display area are not equal, so that resistances of the data lines in a fan-out area are not consistent, resulting in voltage change delay times of the data lines being different. For the convenience of description, the data lines are divided into first data lines and second data lines. The first data lines are data lines distributed in a region where a color shift needed to be improved, and the second data lines are data lines distributed in a region where an image is ideally displayed.

Step S200: controlling data output signals of the data lines according to the voltage change delay times. The data output signals are output signals of data delivered from the driver IC to the display area, i.e., TP signals. Since voltage change delay times of wires of the first data line and the second data line in the fan-out area are different, if a failing edge time of the data output signals of the first data line is set to be same as a failing edge time of the data output signal of the second data line, which will result in that on a same scan line, effective charging times of pixels corresponding to the first data line and the second data line are different and thereby the color shift issue is occurred. Therefore, by controlling a relative shift of the failing edge times of the data output signals of the first data lines and the second data line, such as to be advanced or to be postponed, which may make the effective charging times of them be consistent.

Step S300: adjusting a scan line driving voltage signal according to the data output signals and thereby making effective charging times of pixels on a same scan line and driven by different data lines be consistent. The scan line driving voltage signal is provided by a scan line driver IC and an effect thereof is to control thin film transistor (TFT) switches so as to drive the display panel. When a failing edge time of the data output signal arrives, the scan line driving voltage signal is inputted, and at this time color data information on the data lines are delivered to corresponding TFT switches through wires in the fan-out area to control rotation of liquid crystal. Therefore, by controlling the failing edge times of the data output signals, it may make effective charging times of pixels on the same scan line and corresponding to the first data line and the second data line tend to be consistent, and cooperative with the scan line driving voltage signal, charging efficiencies of them are made to be equal, so that the color shift issue of image display is improved consequently.

In the above embodiment, before the step S100, the driving method further includes: selecting the second data line and setting a failing edge time of the data output signal of the second data line. Herein, the second data line may be any one of the output wires of the driver IC, and according to the demand of image display, the second data line represents a display of ideal image. Moreover, the voltage change delay time of the second data line is preset, and an effective charging time of the pixel on the second data line is a preset effective charging time. The voltage change delay time and the effective charging time are corresponded in one-to-one manner, so that the effective charging time of the pixel on the first data line can be obtained according to detected voltage change delay time of the first data line, and the failing edge time of the data output signal of the first data line can be set according to the effective charging time of the pixel on the second data line. For example, on the same one scan line, when the effective charging time of the pixel on the first data line is longer than the effective charging time of the pixel on the second data line, the failing edge time of the data output signal of the first data line will be postponed; and when the effective charging time of the pixel on the first data line is shorter than the effective charging time of the pixel on the second data line, the failing edge time of the data output signal of the first data line is advanced.

Figure 2:
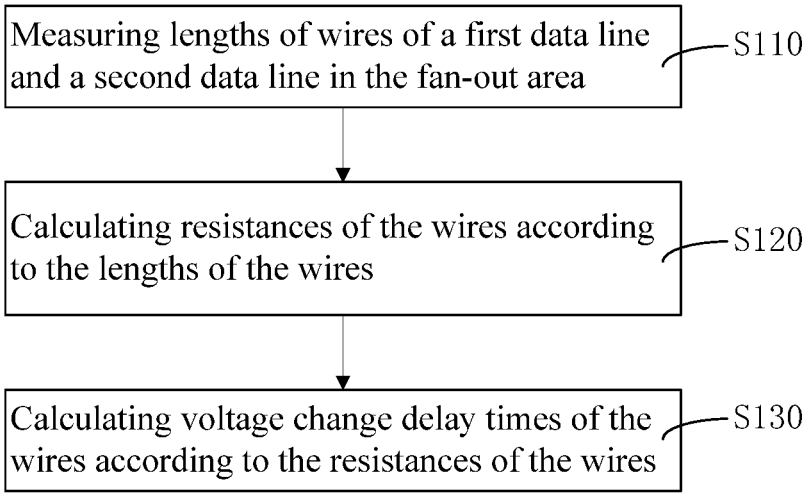
FIG. 2 is a flowchart of an implementation method of step S100 in FIG. 1.

In a concrete embodiment, as shown in FIG. 2, the step S100 includes following steps.

Step S110: measuring lengths of wires of a first data line and a second data line in the fan-out area.

Step S120: calculating resistances of the wires according to the lengths of the wires.

Step S130: calculating voltage change delay times of the wires according to the resistances of the wires.

Moreover, the calculation of the voltage change delay times of the wires requires to determine parameters that: charging capacitor (C), voltage (V0) between the charging capacitor and resistor, and voltage (V1) when the charging capacitor completes the charging. When the resistance of the wire obtained by calculating is R, the voltage change delay time of the wire is:

$$R*C*\ln((V0-V1)/V0)$$

where, ln represents natural logarithm.

Figure 3:
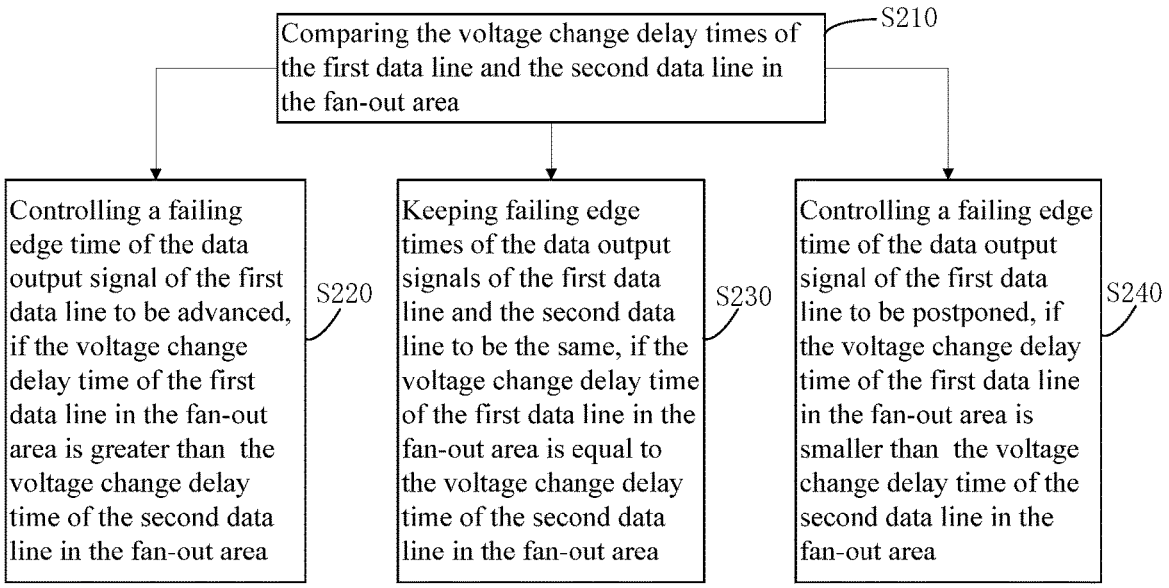
FIG. 3 is a flowchart of an implementation method of step S200 in FIG. 1.

In a concrete embodiment, as shown in FIG. 3, the step S200 includes following steps.

Step S210: comparing the voltage change delay times of the first data line and the second data line in the fan-out areas.

Step S220: controlling a failing edge time of the data output signal of the first data line to be advanced if the voltage change delay time of the first data line in the fan-out area is greater than the voltage change delay time of the second data line in the fan-out area.

Step S230: keeping failing edge times of the data output signals of the first data line and the second data line to be the same if the voltage change delay time of the first data line in the fan-out area is equal to the voltage change delay time of the second data line in the fan-out area.

Step s240: controlling a failing edge time of the data output signal of the first data line to be postponed if the voltage change delay time of the first data line in the fan-out area is smaller than the voltage change delay time of the second data line in the fan-out area.

In the illustrated embodiment, the voltage change delay time is a delayed time length of voltage change, the effective charging time can be determined by the voltage change delay time, and by adjusting the failing edge times of the data output signals of the first data line and the second data line, it may make effective charging times of pixels on the same scan line and driven by the data lines be consistent.

Figure 4:
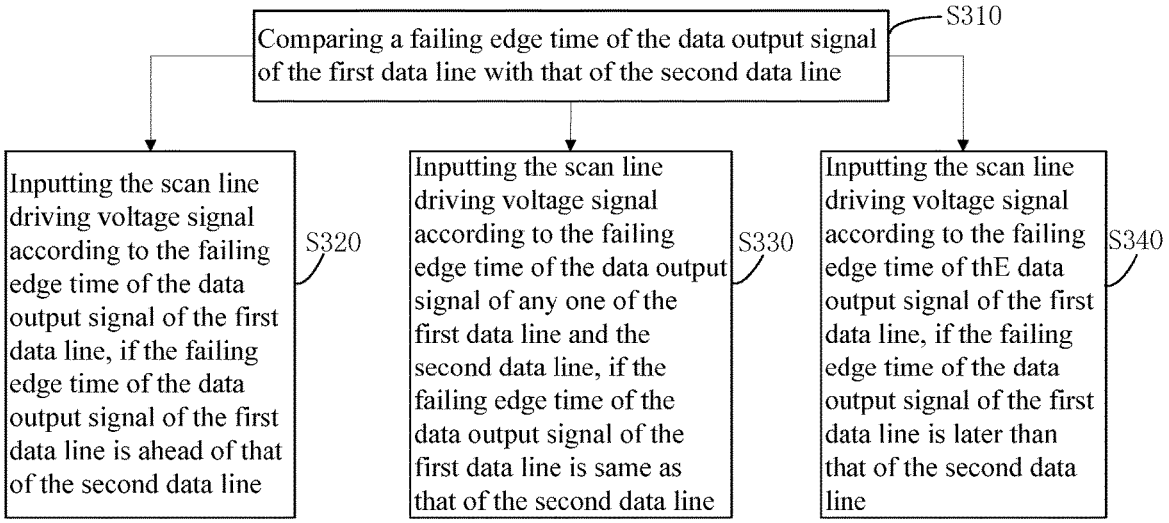
FIG. 4 is a flowchart of an implementation method of step S300 in FIG. 1.

In a concrete embodiment, as shown in FIG. 4, the step S300 includes following steps.

Step S310: comparing a failing edge time of the data output signal of the first data line with that of the second data line;

Step S320: inputting the scan line driving voltage signal according to the failing edge time of the data output signal of the first data line if the failing edge time of the data output signal of the first data line is ahead of that of the second data line.

Step S330: inputting the scan line driving voltage signal according to the failing edge time of the data output signal of any one of the first data line and the second data line if the failing edge time of the data output signal of the first data line is the same as that of the second data line.

Step S340: inputting the scan line driving voltage signal according to the failing edge time of the data output signal of the second data line if the failing edge time of the data output signal of the first data line is later than that of the second data line.

In the illustrated embodiment, the scan line driving voltage signal is issued from the scan line driver chip and an effect thereof is to control TFT switches and thereby control charging and discharging of pixels. A row driving is taken as an example, when the scan line driving voltage signal is inputted, the TFT switches on the row where the scan line is located are simultaneously turned on, and pixels on the rows are charged to respective required voltages. However, because the failing edge times of the data output signals of the first data line and the second data line after being adjusted are in sequence, the scan line driving voltage signal ought to take the data line whose failing edge time of the data output signal is on the front as an input criteria. That is, when a voltage signal of the data line whose the failing edge time of the data output signal is on the front is inputted, the scan line driving voltage signal is simultaneously inputted, so as to make the data line whose failing edge time of the data output signal is on the front be charged.

Figure 5:
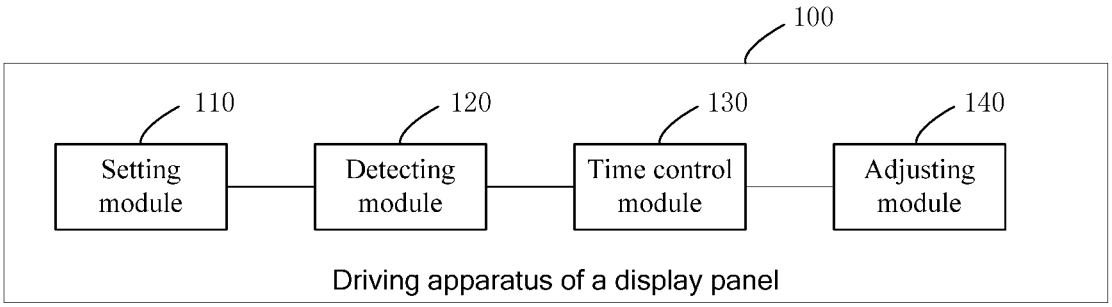
FIG. 5 is a structural block diagram of a driving apparatus of a display panel according to an embodiment.

FIG. 5 is a structural block diagram of a driving apparatus of a display panel according to an embodiment. The driving apparatus 100 of a display panel includes: a setting module 110, a detecting module 120, a time control module 130 and an adjusting module 140.

The setting module 110 is configured (i.e., structured and arranged) to select a second data line and set a data output signal of the second data line.

The detecting module 120 is configured to detect voltage change delay times of a first data line and the second data line in a fan-out area.

The time control module 130 is configured to control data output signals of the first data line and the second data line according to the voltage change delay times.

The adjusting module 140 is configured to adjust a scan line driving voltage signal according to the data output signals and thereby make effective charging times of pixels on a same scan line and driven by the first data line and the second data line be consistent.

The driving apparatus 100 of a display panel detects voltage change delay times of the data lines whose wire distances (lengths) in the fan-out area are not equal, determines effective charging times of pixels on the respective data lines based on the voltage change delay times, controls failing edge times of the data output signals of the respective data lines according to the effective charging times, and finally adjusts a waveform of the scan line driving voltage to make their effective charging efficiencies be consistent. Such driving apparatus 100 of a display panel can avoid: TFT-LCD process modification and process yield problems as well as cost increase problem caused by using the copper material to manufacture wires of the data lines, and cost increase problem caused by the number of the data line driver chips being increased resulting from the decrease of the number of output channels of each data line driver chip.

Figure 6:
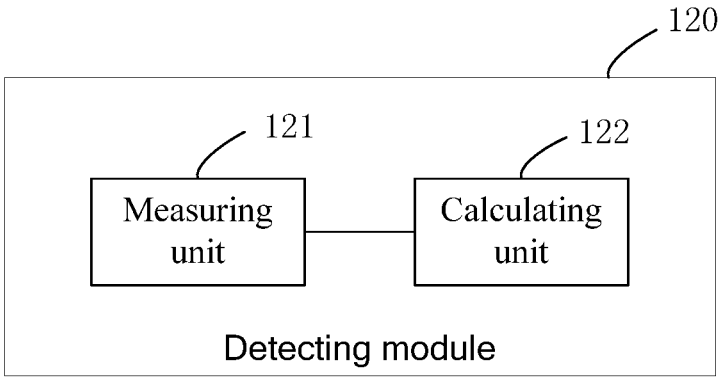
FIG. 6 is a structural block diagram of a module 120 in FIG. 5.

In a concrete embodiment, as shown in FIG. 6, the detecting module 120 includes a measuring unit 121 and a calculating unit 122.

The measuring unit 121 is configured to measure lengths of wires of the first data line and the second data line in the fan-out area.

The calculating unit 122 is configured to calculate resistances of the wires according to the lengths of the wires and calculate the voltage change delay times according to the resistances of the wires.

In an embodiment, the measuring unit 121 further is configured to measure a charging capacitor (C), a voltage (V0) between the charging capacitor and a resistor, and a voltage (V1) when the charging capacitor completes the charging. The calculating unit 122, based on the measured parameters, calculates the resistance R of the wire and the voltage change delay time:

$$R*C*\ln((V0-V1)/V0).$$

Figure 7:
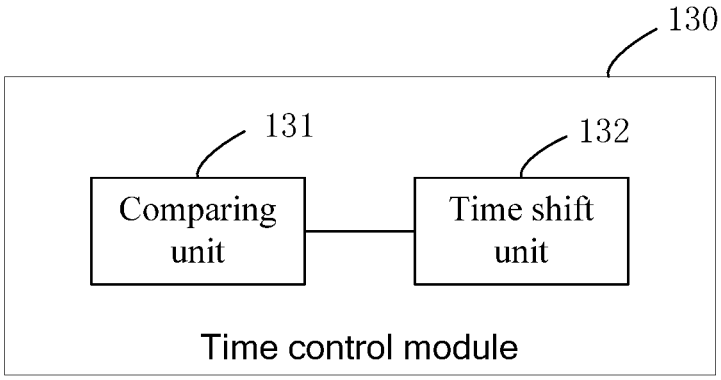
FIG. 7 is a structural block diagram of a module 130 in FIG. 5.

In a concrete embodiment, as shown in FIG. 7, the time control module 130 includes a comparing unit 131 and a time shift unit 132.

The comparing unit 131 is configured to compare the voltage change delay times of the first data line and the second data line in the fan-out area.

The time shift unit 132 is configured to control the failing edge time of the data output signal of the first data line to be advanced or postponed.

If the voltage change delay time of the first data line in the fan-out area is greater than the voltage change delay time of the second data line in the fan-out area, the failing edge time of the data output signal of the first data line is controlled to be advanced.

If the voltage change delay time of the first data line in the fan-out area is equal to the voltage change delay time of the second data line in the fan-out area, failing edge times of the data output signals of the first data line and the second data line are kept to be the same.

If the voltage change delay time of the first data line in the fan-out area is smaller than the voltage change delay time of the second data line in the fan-out area, the failing edge time of the data output signal of the first data line is postponed.

In an embodiment, the voltage change delay time is a delayed time length of voltage change, the effective charging time can be determined by the voltage change delay time, and by adjusting the failing edge times of the data output signals of the first data line and the second data line, it can make the effective charging times of the pixels on the same scan line and driven by the data line be consistent.

In an embodiment, the time shift unit 132 is a timing controller (TCON). The timing controller can control the output signals of data delivered from the driver chip to the display screen (data output signals), that is, the timing controller can realize the failing edge time of the data output signal to be advanced or postponed by programming.

Figure 8:
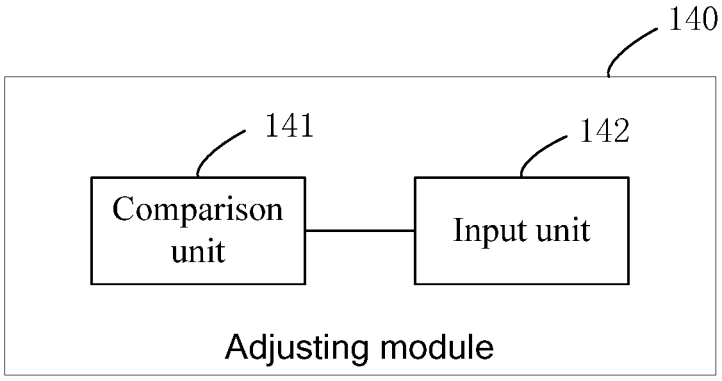
FIG. 8 is a structural block diagram of a module 140 in FIG. 5.

In a concrete embodiment, as shown in FIG. 8, the adjusting module 140 includes a comparison unit 141 and an input unit 142.

The comparison unit 141 is configured to compare the failing edge time of the data output signal of the first data line with that of the second data line.

The input unit 142 is configured to input the scan line driving voltage signal.

If the failing edge time of the data output signal of the first data line is ahead of that of the second data line, the scan line driving voltage signal is inputted according to the failing edge time of the data output signal of the first data line.

If the failing edge time of the data output signal of the first data line is same as that of the second data line, the scan line driving voltage signal is inputted according to the failing edge time of the data output signal of any one of the first data line and the second data line.

If the failing edge time of the data output signal of the first data line is later than that of the second data line, the scan line driving voltage signal is inputted according to the failing edge time of the data output signal of the second data line.

Figure 9:
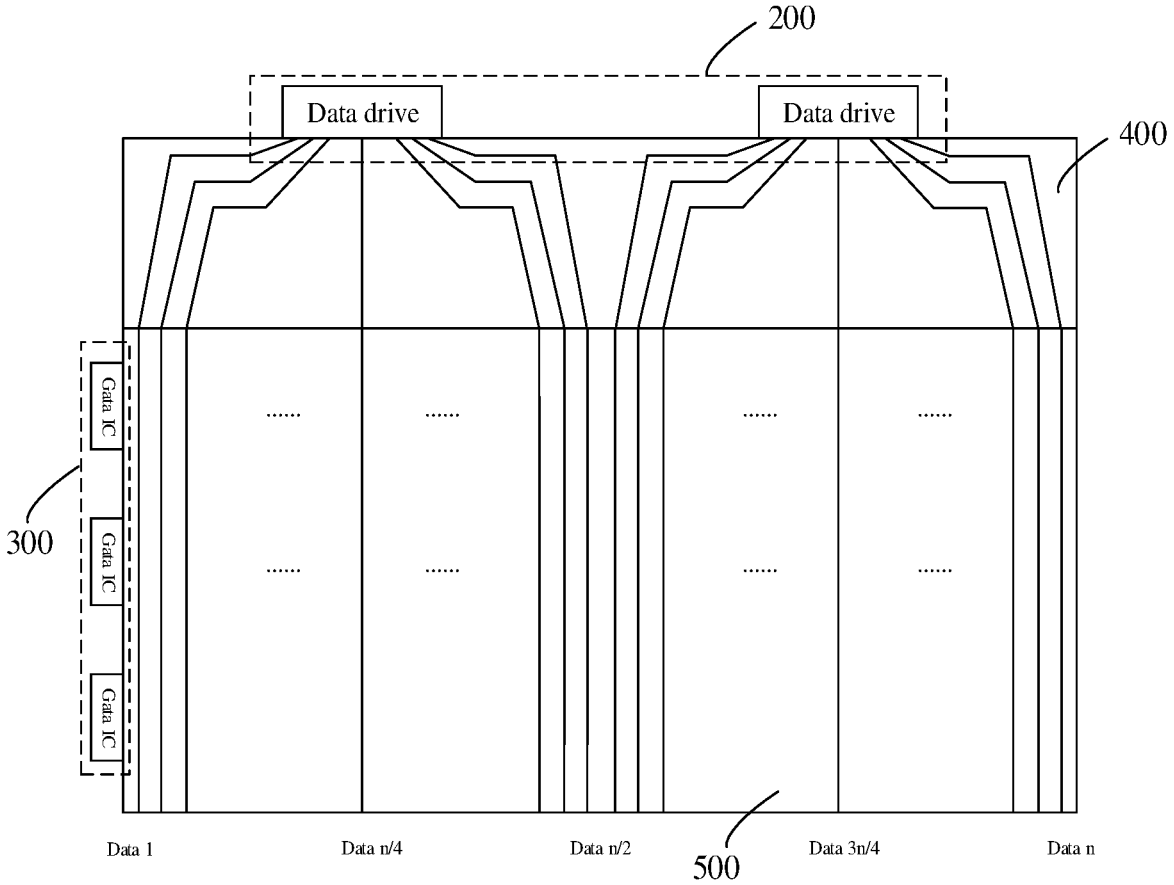
FIG. 9 is a schematic view of a display apparatus of a display panel according to an embodiment.

The above driving method of a display panel is applied to a display apparatus. In particular, as shown in FIG. 9, it is a schematic view of the display apparatus of a display panel according to an embodiment. The display apparatus includes two data line driver chips (e.g., data drives) 200, three scan line driver chips (e.g., gate ICs) 300 and a display panel. Outputs of the data line driver chips 200 are connected to multiple data lines respectively being Data 1, Data 2, . . . , Data n. Outputs of the gate line driver chips 300 are connected to multiple scan lines Gate 1, Gate 2, . . . , Gate n (not shown in the figure). The display panel may be divided into a fan-out area 400 and a display area 500 according to wiring manner of the data lines. In the fan-out area, lengths of wires of the data lines are different, the wire of the data line located at a middle position of the data line driver chip is the shortest, and lengths of wires of the data lines progressively increase from the middle position towards two sides. In the display area, lengths of wires of the data lines are consistent.

Figure 10:
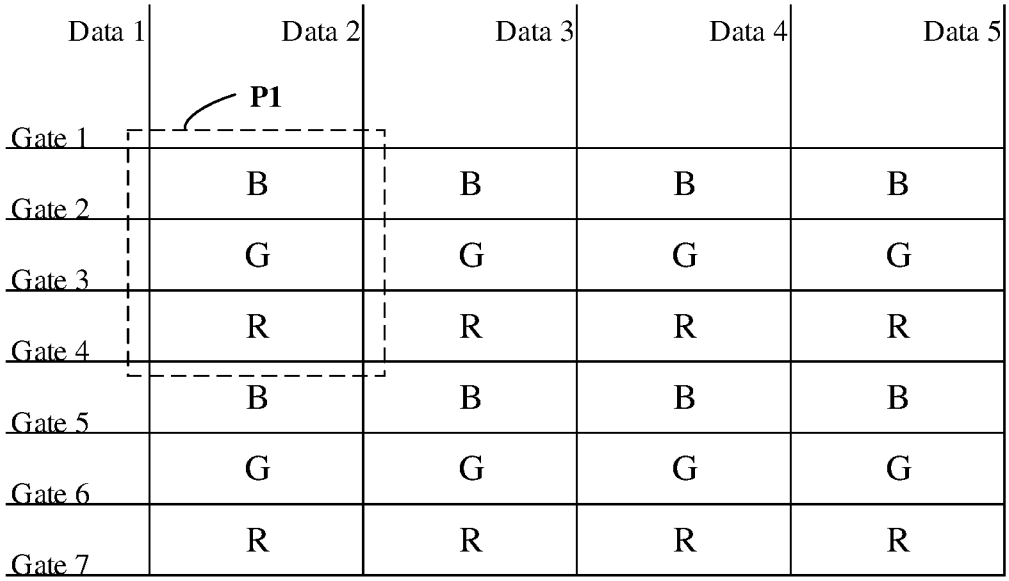
FIG. 10 is a schematic view of an arrangement of pixels in a display area 500 in FIG. 9.

In particular, as shown in FIG. 10, it is a schematic view of an arrangement of pixels in the display area 500 in FIG. 9. Each pixel unit of the display panel includes three sub-pixels of three different colors such as red (R), green (G) and blue (B). Each pixel unit is disposed with one data line and three scan lines. Moreover, each sub-pixel is driven by corresponding scan lines. Each pixel unit is driven by a corresponding data line. For example, the pixel unit P1 is disposed with the data line Data 1 and the scan lines Gate 1, Gate 2 and Gate 3. The data line Data 1 is used to input color data information. The scan lines Gate 1, Gate 2 and Gate 3 respectively are used to control TFT switches of the blue (B), green (G) and red (R) sub-pixels in the pixel unit and thereby control the writing of color data information. However, since different data lines have different voltage change delay times, during controlling the writing of mixed color image data information, long data lines are charged inadequately, resulting in insufficient writing of some colors, so that a color difference would be occurred in image display.

Figure 11:
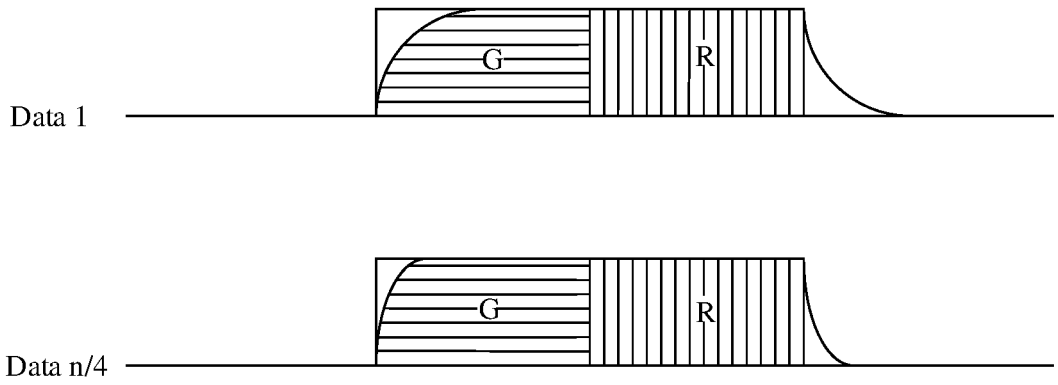
FIG. 11 is a schematic view of voltage change delays of data lines in FIG. 9.

In a concrete embodiment, as shown in FIG. 11, it is a schematic view of voltage change delays of the data lines Data 1 and Data n/4 in FIG. 9 since the data line Data 1 is far away from the middle position of the data line driver chip 200 and the data line Date n/4 is just located at the middle position of the data line driver chip 200, the wire of the data line Data 1 in the fan-out area is longer than the wire of the data line Date n/4 in the fan-out area, the resistance thereof correspondingly is larger, and the generated voltage change delay is more serious, so that the charging efficiency is lower. As seen from the figure, the horizontal shaded area represents a charging efficiency of a green (G) sub-pixel, and the vertical shaded area represents a charging efficiency of a red (R) sub-pixel. The horizontal shaded area of the data line Data 1 is smaller than the horizontal shaded area of the data line Data n/4, i.e., the charging efficiency of the green (G) sub-pixel on the data line Data 1 is lower than the charging efficiency of the green (G) sub-pixel on the data line Date n/4. Therefore, when displaying a yellow image, if the pixel unit is firstly written with green and then written with red, the green (G) data information of the data line Data 1 is written inadequately due to insufficient charging efficiency, compared with the region where the data line Data n/4 is located, the region where the data line Data 1 is located is reddish yellow.

Figure 12:
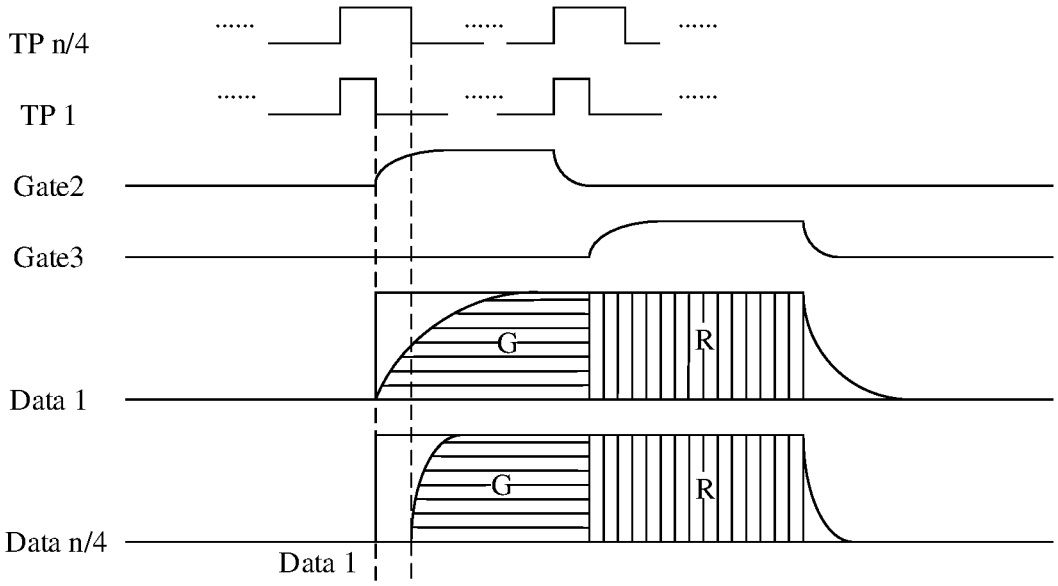
FIG. 12 is a schematic view of relationships among data output signals, data lines and scan lines in FIG. 9.

Moreover, as shown in FIG. 12, it is a schematic view of relationships among data output signals, data lines and scan lines in FIG. 9. In the figure, the data output signal corresponding to the data line Data 1 is TP1, the data output signal corresponding to the data line Data n/4 is TP n/4. When displaying a yellow image, since the failing edge time of the data output signal of the data line Data 1 is ahead of the failing edge time of the data output signal of the data line Data n/4, when the failing edge time of the data output signal of the data line Data 1 arrives, the scan line Gate 2 inputs a driving voltage signal and then the data line Data 1 writes the green (G) data information. When the writing of green (G) data information is completed, the driving voltage signal on the scan line Gate 2 is turned off, the scan line Gate 3 inputs a driving voltage signal, and then the data line Date 1 starts to write red (R) data information. Likewise, the data line Data n/4 also performs the above color writing process after the data line Data 1. As seen from the figure, it can be found that, the horizontal shaded area represents a charging efficiency of the green (G) data information, and the vertical shaded area represents a charging efficiency of the red (R) data information. By adjusting the failing edge time of a suitable data output signal, it can make the charging efficiencies of the green (G) data information of the data line Data 1 and the data line Data n/4 be consistent, and the color shift problem is improved consequently.

The above display apparatus may be a display apparatus with tri-gate driving architecture and an arrangement of pixels is a vertical arrangement with RGB points inversion, but it is not limited to this. The driving method of a display panel of the disclosure also can be applied to other display apparatuses and display panels, for example, LCD (liquid crystal display) panels, OLED (Organic Light Emitting Diode) display panels, curved type display panels or other display panels.

When the display apparatus is a liquid crystal display apparatus, the display apparatus may be a TN type, an OCB type, a VA type or a curved type liquid crystal display apparatus, but it is not limited to these. The liquid crystal display apparatus can employ a direct-type backlight, and a backlight source may be a white light source, a RGB three-color light source, a WRGB four-color light source or an YRGB four-color light source, and it is not limited to these.

Figure 13:
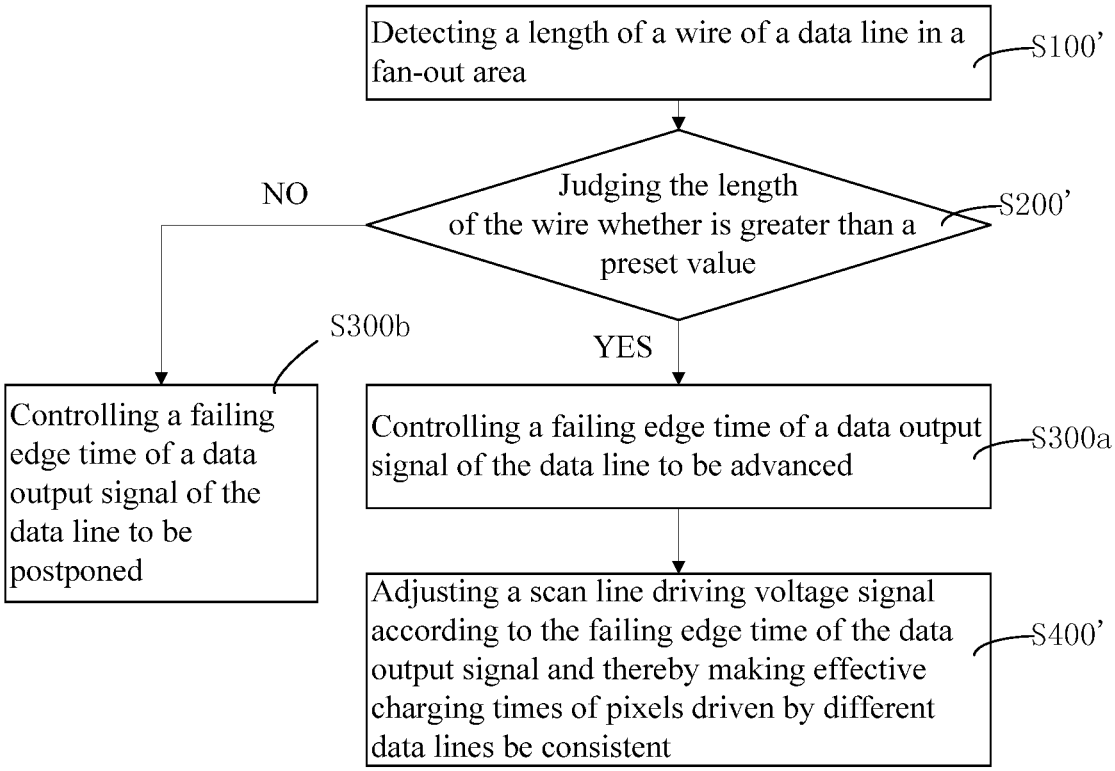
FIG. 13 is a flowchart of a driving method of a display panel according to another embodiment.

In an embodiment, as shown in FIG. 13, a driving method of a display panel includes following steps.

Step S100': detecting a length of a wire of a data line in a fan-out area. Lengths of wires of the data lines in the fan-out area of the display panel are not equal, and the lengths of wires are related to distributed positions in the fan-out area. If the display panel has two source drivers respectively for driving the left half part and the right half part of the display panel, the wires of data lines in the central position and two sides of the fan-out area are relatively longer.

Step S200': judging the length of the wire whether is greater than a preset value, if the judging result is "YES", goes to the step S300*a*, and if the judging result is "NO", goes to the step S300*b*. In the display panel, the length of a wire of a data line in the fan-out area corresponding to a sub-pixel with an ideal image display effect is used as the preset value.

Step S300*a*: controlling a failing edge time of a data output signal of the data line to be advanced.

Step S300*b*: controlling a failing edge time of a data output signal of the data line to be postponed.

Step S400': adjusting a scan line driving voltage signal according to the failing edge time of the data output signal and thereby making effective charging times of pixels driven by different data lines be consistent.

The foregoing driving method and driving apparatus of a display panel, by changing failing edge times of data output signals of different data lines, they can improve the color shift problem caused by different voltage change delays and enhance the optical grade of product. Moreover, the method does not change the process requirements and product cost.

The technical features of the above embodiments can be combined arbitrarily. In order to make the description concise, not all possible combinations of the technical features in the above embodiments are described. However, as long as there is no contradiction in a combination of these technical features, it should be considered as the scope of this specification.

In the several embodiments provided by the disclosure, it should be understood that the described systems, devices and/or methods can be realized in other ways. For example, the embodiments of devices described above are merely illustrative. For example, division of units is only a logical functional division, and other division manner may be adopted in actual implementation, for example multiple units or components can be combined together or integrated into another system, or some features can be omitted or not implemented. In addition, the coupling or direct coupling or communication connection shown or discussed may be indirect coupling or communication connection through some interfaces, devices or units, which may be electrical, mechanical or otherwise.

The units described as separation parts may or may not be physically separated, and the parts shown as units may or may not be physical units, i.e., may be located in one place or distributed over multiple network units. Some or all of the units can be selected according to actual needs to achieve the purpose of the embodiments of the disclosure.

In addition, each of the functional units in the embodiments of the disclosure may be integrated in one processing unit, or each of the units may exist alone physically, or two or more units may be integrated in one unit. The integrated unit can be implemented in the form of hardware or in the form of hardware plus a software functional unit(s).

The integrated unit implemented in the form of a software functional unit(s) may be stored in a computer-readable storage medium. The above software functional unit(s) is/are stored in a storage medium and include(s) several instructions for causing one or more processors of a computer device (which may be a personal computer, a server, or a network device) to execute some steps of the method described in the above embodiments of the disclosure. The foregoing storage medium may be any one various types of media can store program codes such as a USB disk, a mobile hard disk, a read-only memory (ROM), a random access memory (RAM), a magnetic disk or an optical disk.

Finally, it should be noted that the above embodiments are merely illustrative of technical solutions of the disclosure and are not intended to be limiting thereof. Although the disclosure is described in detail with reference to the foregoing embodiments, a person skilled in the art should be understood that the technical solutions described in the foregoing embodiments can be modified or some of technical features can be equivalently replaced, and these modifications or replacements do not depart from the spirit and scope of the technical solutions of various embodiments of the disclosure.

What is claimed is:

1. A driving method of a display panel, comprising:

detecting voltage change delay times of data lines in a fan-out area, wherein the data lines comprise a first data line and a second data line;

controlling data output signals of the data lines according to the voltage change delay times;

adjusting a scan line driving voltage signal according to the data output signals and thereby making effective charging times of pixels driven by different data lines be consistent;

wherein the step of controlling data output signals of the data lines according to the voltage change delay times comprises:

comparing the voltage change delay times of the first data line and the second data line in the fan-out area;

controlling a failing edge time of the data output signal of the first data line to be advanced if the voltage change delay time of the first data line in the fan-out area is greater than the voltage change delay time of the second data line in the fan-out area;

controlling failing edge times of the data output signals of the first data line and the second data line to be the same if the voltage change delay time of the first data line in the fan-out area is equal to the voltage change delay time of the second data line in the fan-out area;

controlling a failing edge time of the data output signal of the first data line to be postponed if the voltage change delay time of the first data line in the fan-out area is smaller than the voltage change delay time of the second data line in the fan-out area;

wherein the step of adjusting a scan line driving voltage signal according to the data output signals and thereby making effective charging times of pixels driven by different data lines be consistent comprises:

comparing a failing edge time of the data output signal of the first data line with a failing edge time of the data output signal of the second data line;

inputting the scan line driving voltage signal according to the failing edge time of the data output signal of the first data line if the failing edge time of the data output signal of the first data line is ahead of the failing edge time of the data output signal of the second data line;

inputting the scan line driving voltage signal according to the failing edge time of the data output signal of any one of the first data line and the second data line if the failing edge time of the data output signal of the first data line is same as the failing edge time of the data output signal of the second data line;

inputting the scan line driving voltage signal according to the failing edge time of the data output signal of the second data line if the failing edge time of the data output signal of the first data line is later than the failing edge time of the data output signal of the second data line.

2. The driving method of a display panel as claimed in claim 1, wherein before detecting voltage change delay times of data lines in a fan-out area, the driving method comprises:

selecting the second data line and setting the failing edge time of the data output signal of the second data line.

3. The driving method of a display panel as claimed in claim 1, wherein the step of detecting voltage change delay times of data lines in a fan-out area comprises:

measuring lengths of wires of the first data line and the second data line in the fan-out area;

calculating resistances of the wires according to the lengths of the wires;

calculating voltage change delay times of the wires according to the resistances of the wires.

4. The driving method of a display panel as claimed in claim 1, wherein before detecting voltage change delay times of data lines in a fan-out area, the driving method comprises:

selecting the second data line and setting the failing edge time of the data output signal of the second data line;

wherein the step of detecting voltage change delay times of data lines in a fan-out area comprises:

measuring lengths of wires of the first data line and the second data line in the fan-out area;

calculating resistances of the wires according to the lengths of the wires;

calculating voltage change delay times of the wires according to the resistances of the wires.

5. The driving method of a display panel as claimed in claim 1, wherein the display panel is a liquid crystal display panel, an organic light emitting diode display panel or a curved type display panel.

6. The driving method of a display panel as claimed in claim 1, wherein the display panel comprises the fan-out area and a display area; lengths of wires of the first data line and the second data lines in the fan-out area are different, and lengths of wires of the first data line and the second data line in the display area are the same.

7. A driving apparatus of a display panel, comprising:

a setting module, configured to select a second data line and set a data output signal of the second data line;

a detecting module, configured to detect voltage change delay times of a first data line and the second data line in a fan-out area;

a time control module, configured to control data output signals of the first data line and the second data line according to the voltage change delay times;

an adjusting module, configured to adjust a scan line driving voltage signal according to the data output signals and thereby make effective charging times of pixels driven by the first data line and the second data line be consistent;

wherein the time control module comprises a first comparing unit and a time shift unit;

the first comparing unit is configured to compare the voltage change delay times of the first data line and the second data line in the fan-out area;

the time shift unit is configured to control a failing edge time of the data output signal of the first data line to be advanced or postponed;

wherein the failing edge time of the data output signal of the first data line is controlled to be advanced if the voltage change delay time of the first data line in the fan-out area is greater than the voltage change delay time of the second data line in the fan-out area;

wherein failing edge times of the data output signals of the first data line and the second data line are kept to be the same if the voltage change delay time of the first data line in the fan-out area is equal to the voltage change delay time of the second data line the fan-out area;

wherein the failing edge time of the data output signal of the first data line is controlled to be postponed if the voltage change delay time of the first data line in the fan-out area is smaller than the voltage change delay time of the second data line in the fan-out area;

wherein the adjusting module comprises a second comparison unit and an input unit;

the second comparison unit is configured to compare a failing edge time of the data output signal of the first data line with a failing edge time of the data output signal of the second data line;

the input unit is configured to input the scan line driving voltage signal;

wherein the scan line driving voltage signal is inputted according to the failing edge time of the data output signal of the first data line if the failing edge time of the data output signal of the first data line is ahead of the failing edge time of the data output signal of the second data line;

wherein the scan line driving voltage signal is inputted according to the failing edge time of the data output signal of any one of the first data line and the second data line if the failing edge time of the data output signal of the first data line is same as the failing edge time of the data output signal of the second data line;

wherein the scan line driving voltage signal is inputted according to the failing edge time of the data output signal of the second data line if the failing edge time of the data output signal of the first data line is later than the failing edge time of the data output signal of the second data line.

8. The driving apparatus of a display panel as claimed in claim 7, wherein the detecting module comprises a measuring unit and a calculating unit;

the measuring unit is configured to measure lengths of wires of the first data line and the second data line in the fan-out area;

the calculating unit is configured to calculate resistances of the wires according to the lengths of the wires and calculate voltage change delay times according to the resistances of the wires.

9. The driving apparatus of a display panel as claimed in claim 7, wherein the display panel is a liquid crystal display panel, an organic light emitting diode display panel or a curved type display panel.

10. The driving apparatus of a display panel as claimed in claim 7, wherein the display panel comprises the fan-out area and a display area; lengths of wires of the first data line and the second data line in the fan-out area are different, and lengths of wires of the first data line and the second data line in the display area are consistent.

* * * * *